US006770006B2

(12) United States Patent
Abrahamsen

(10) Patent No.: US 6,770,006 B2
(45) Date of Patent: Aug. 3, 2004

(54) ACTUATOR

(75) Inventor: John Abrahamsen, Nordborg (DK)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 10/240,214

(22) PCT Filed: Mar. 28, 2001

(86) PCT No.: PCT/DK01/00211

§ 371 (c)(1),
(2), (4) Date: Sep. 30, 2002

(87) PCT Pub. No.: WO01/75334

PCT Pub. Date: Oct. 11, 2001

(65) Prior Publication Data

US 2003/0101837 A1 Jun. 5, 2003

(30) Foreign Application Priority Data

Mar. 31, 2000 (DK) ..... 2000 00534

(51) Int. Cl.[7] ..... F16H 57/08; F16H 37/00
(52) U.S. Cl. ..... 475/343; 475/345; 74/15.6
(58) Field of Search ..... 475/343, 345, 475/333, 209, 214; 74/15.6, 15.63, 417, 423, 424, 425

(56) References Cited

U.S. PATENT DOCUMENTS 3,552,225 A 1/1971 Van Voorhis
3,645,148 A * 2/1972 Schrempp ..... 74/423
3,765,260 A 10/1973 Lucas et al.
3,949,626 A * 4/1976 Berlinger, Jr. et al. ..... 475/7
4,026,163 A 5/1977 Merkert
4,504,239 A * 3/1985 Kulesza et al.
4,700,589 A * 10/1987 Coronel ..... 475/6
5,042,315 A * 8/1991 Fahy et al. ..... 74/411
5,080,640 A * 1/1992 Botterill ..... 475/231
5,102,019 A * 4/1992 Lam ..... 223/94
5,195,427 A * 3/1993 Germano ..... 99/472
5,448,792 A * 9/1995 Wiedemann et al. ..... 15/22.1
5,501,117 A * 3/1996 Mensing et al. ..... 74/420

FOREIGN PATENT DOCUMENTS

EP 0577541 1/1994
EP 0662573 4/1998

* cited by examiner

*Primary Examiner*—Tisha D Lewis
(74) *Attorney, Agent, or Firm*—Dykema Gossett PLLC

(57) ABSTRACT

An actuator with an electric motor which drives an activation element, such as a rotatable arm or a longitudinally movable rod, via a transmission. The transmission has at least two transmission stages, the first one being formed by a worm drive, the second one being formed by a crown and bevel wheel (5; 4*a*, 4*b*), the bevel wheel (4*a*, 4*b*) being driven by the worm wheel (3*a*, 3*b*), and the crown wheel (5) having a power take-off (15). The transmission may readily be formed so that the axis of the crown wheel (5) is in direct extension of the worm (2). A relatively compact transmission with a high gearing may be achieved hereby, and with worm wheel as well as crown and bevel wheel of plastics the transmission is also comparatively noiseless.

12 Claims, 4 Drawing Sheets

ACTUATOR

FIELD OF THE INVENTION

The present invention relates to an actuator of the type wherein an electric motor drives an activation element, such as a rotatable arm or a longitudinally movable rod, via a transmission, and wherein the transmission has at least two transmission stages, the first one being formed by a worm drive with a worm and a worm wheel.

THE PRIOR ART

Actuators are used inter alia for performing movements and positional adjustments in articles of furniture, including beds and loose mattress supports, sickbeds and hospital beds, nursing equipment, seats for vehicles, machinery and within the industry, etc. Examples of linear actuators may be found in the applicant's EP 647 799 and EP 662 573, both Linak A/S, and DE 38 42 078 Niko Gesellschaft für Antriebstechnik GmbH as well as WO99/16333 Inventions & Developments Holland B.V. An example of a rotary actuator is found in German Utility Model DE 298 02 384 U1 Recticel Internationale Bettsysteme GmbH, which discloses a mattress support with incorporated rotary actuators for adjusting the backrest part and/or the leg-rest part.

The associated electrical equipment is usually a low volt equipment where the actuators are typically driven by a 24V DC motor. The motors available involve the problem that a strong gearing has to take place, as the motors have a relatively high number of revolutions, while the actuator has to move very slowly relatively to this. For example, the motor may have a number of revolutions of the order of 3000 r.p.m., while the actuator performs a full movement in a period of time of the order of 30 sec. or even as slow as 60 sec. Various solutions have been contemplated in order to achieve the high reduction, but these have either been too expensive, too bulky, not sufficiently mechanically stable or too noisy.

The object of the invention is to provide an actuator which allows one or more of these problems to be obviated.

SUMMARY OF THE INVENTION

This is achieved according to the invention with an actuator of the type stated in the opening paragraph, wherein the subsequent transmission stage is formed by a crown and bevel wheel, wherein the bevel wheel is driven by the worm wheel, and wherein the crown wheel has a power take off arranged in extension of, or substantially in extension of, the worm, or in parallel therewith. This provides an actuator having a relatively compact transmission with a high gearing, and with a worm wheel made of plastic, the actuator is moreover comparatively noiseless. Crown and bevel wheels may be manufactured with simple moulding tools, by plastics moulding with a two-jawed tool, so that basically the manufacturing costs may be kept low.

When the transmission comprises an additional worm wheel and bevel wheel arranged diametrically opposite the first worm and bevel wheel, a balanced distribution of the forces is achieved. The worm and the crown wheel are stabilized, and the force distribution may be used for transferring greater forces or reducing dimensions or alternative selections of materials.

In a preferred embodiment the worm wheel and the bevel wheel are formed as one piece, which ensures optimum coupling and also facilitates mounting. The worm (worm gear) and bevel wheels may be made as one plastic member in a two-jawed injection moulding tool.

In a further embodiment the motor housing is provided with a front cover with a mount for the free end of the worm, and the cover is additionally provided with shafts for worm wheel/bevel wheel as well as a shaft for the crown wheel. This has evident advantages in terms of mounting.

When the power take-off of the crown wheel is formed as an axis-parallel toothed wheel, it may readily be used as a sun wheel when built together with a planetary gear. Here, too, it is expedient that the crown wheel and the toothed wheel are made as one piece.

In an embodiment, the shaft of the crown wheel is provided with a bearing bushing, and also the free end of the worm is expediently mounted in a bearing bushing in the front member.

When constructing worm wheel, bevel wheel and crown wheel, the crown having a toothed wheel as power take-off, of plastic, the costs may be reduced while keeping the noise t a low level.

The invention will be explained more fully below with reference to the embodiments illustrated in the accompanying drawings.

DETAILED DESCRIPTION OF THE PREFERRED EMBODIMENTS

Figure 2:
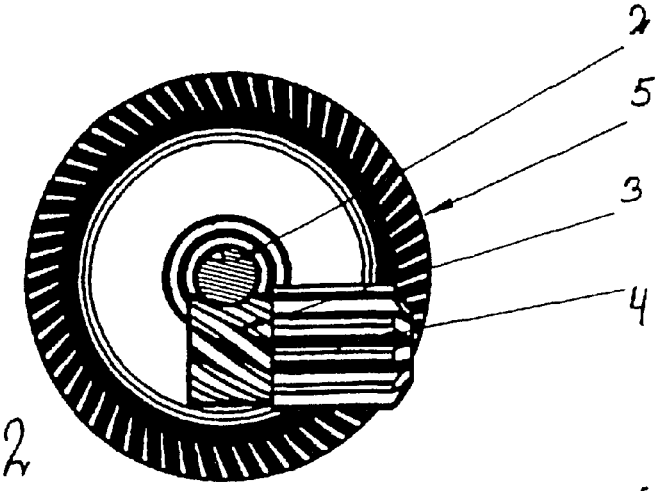
FIG. 2 shows a section along line 11—11 in FIG. 1.
Figure 1:
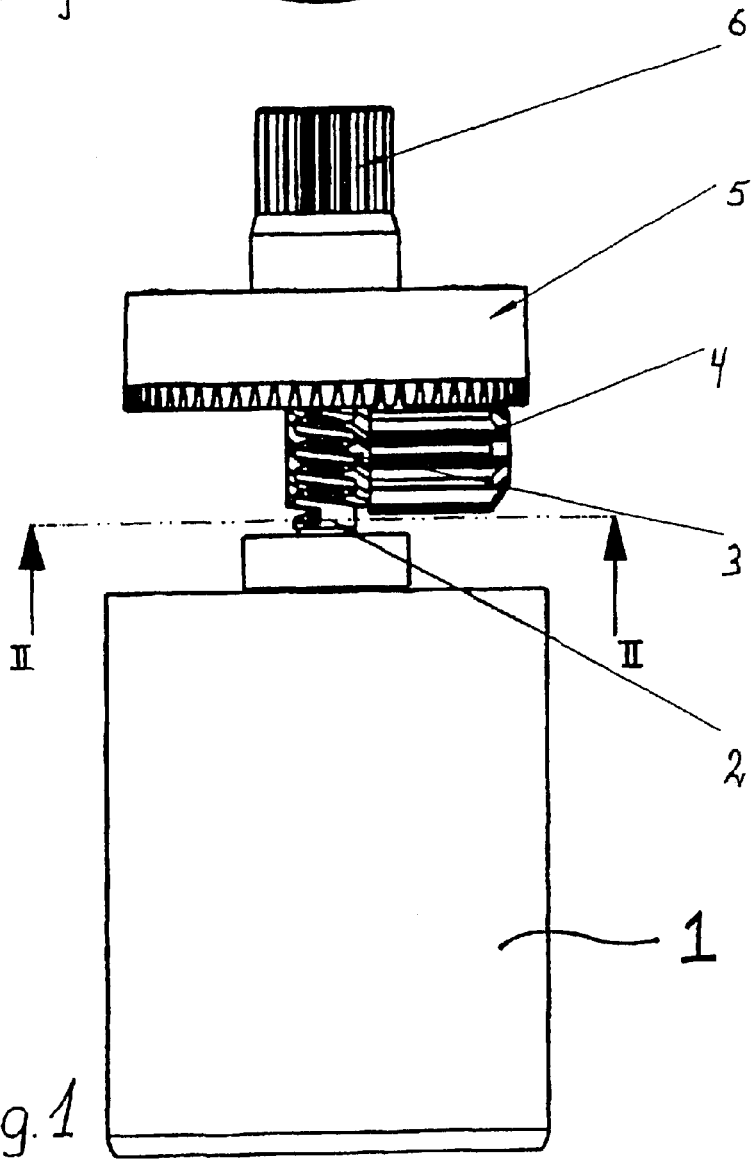
FIG. 1 is a schematic lateral view of a first embodiment of the inventive actuator.

The embodiment illustrated in FIGS. 1 and 2 comprises a 12V or 24V DC motor 1, where a worm gear 2 is formed in an extended part of the motor shaft. The worm gear 2, which is of steel, drives a worm wheel 3 and a bevel wheel 4 which as a unit are moulded of plastic. The bevel wheel 4 drives a crown wheel 5 which is likewise of plastic. The crown wheel has a power take-off 6 for connection with the subsequent transmission. Mounting of the unit worm wheel/bevel wheel and crown wheel may be performed in a housing or frame of the actuator, but an attractive way is mounting on the motor, an example being given in the following.

The bevel wheel 4 is cylindrical here, and the same applies to the crown wheel, in the alternative they might be conical. There is a free choice between the common toothings, straight, skew, helical or hypoid, for satisfying specific requirements.

Figure 3:
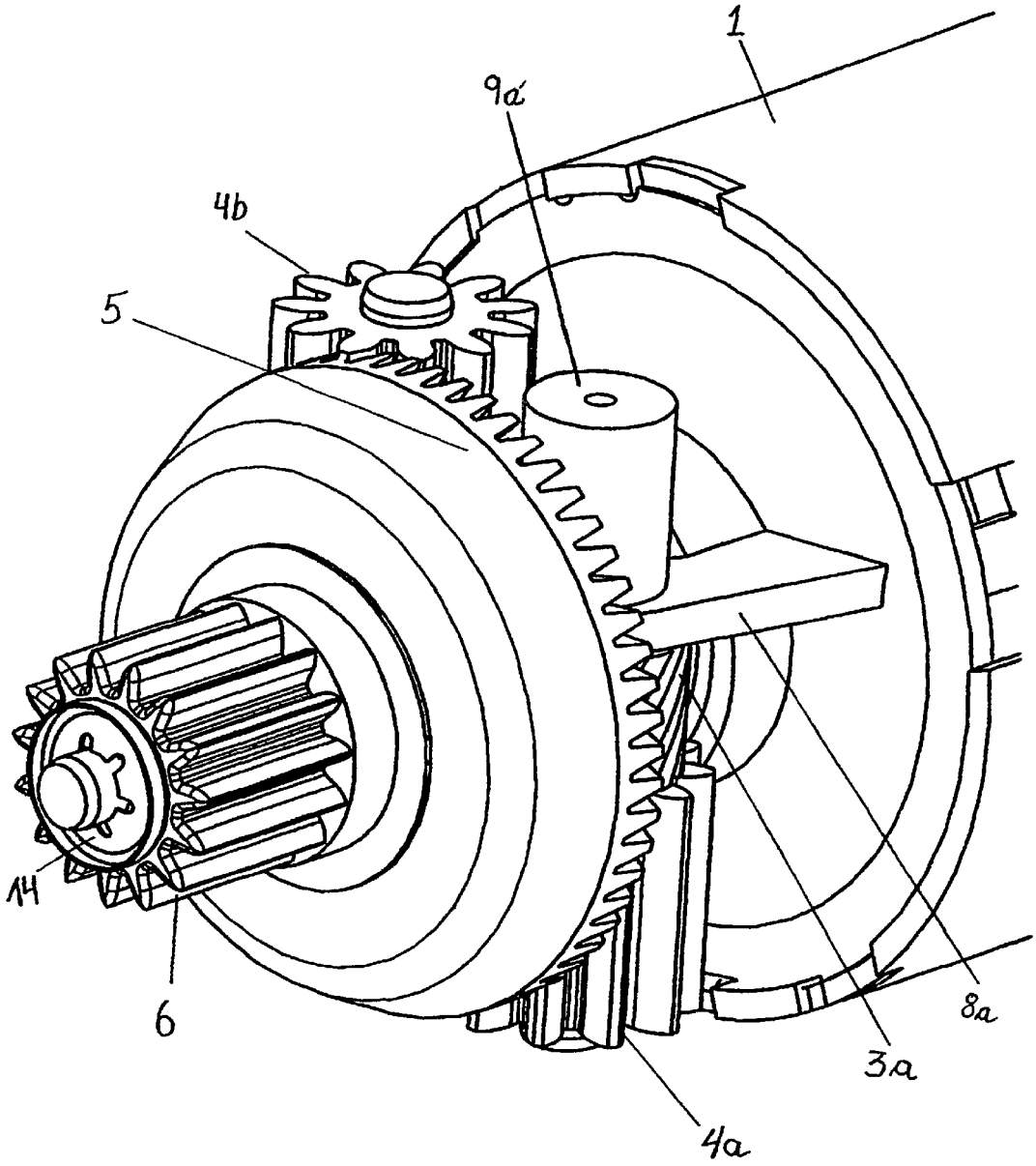
FIG. 3 is a perspective view of a second embodiment, seen from the front.

Using the same reference numerals for the same parts, the embodiment shown in FIG. 3 likewise comprises a 12 or 24V DC motor or other form of servomotor 1. In contrast to the foregoing embodiment, there are here two sets of worm and bevel wheels 3*a*, 4*a*; 3*b*, 4*b* which are arranged diametrically opposite, with the advantages that the forces are distributed and the load on the toothed wheels is reduced, just as the worm and the crown wheel are prevented from flexing outwards.

Figure 4:
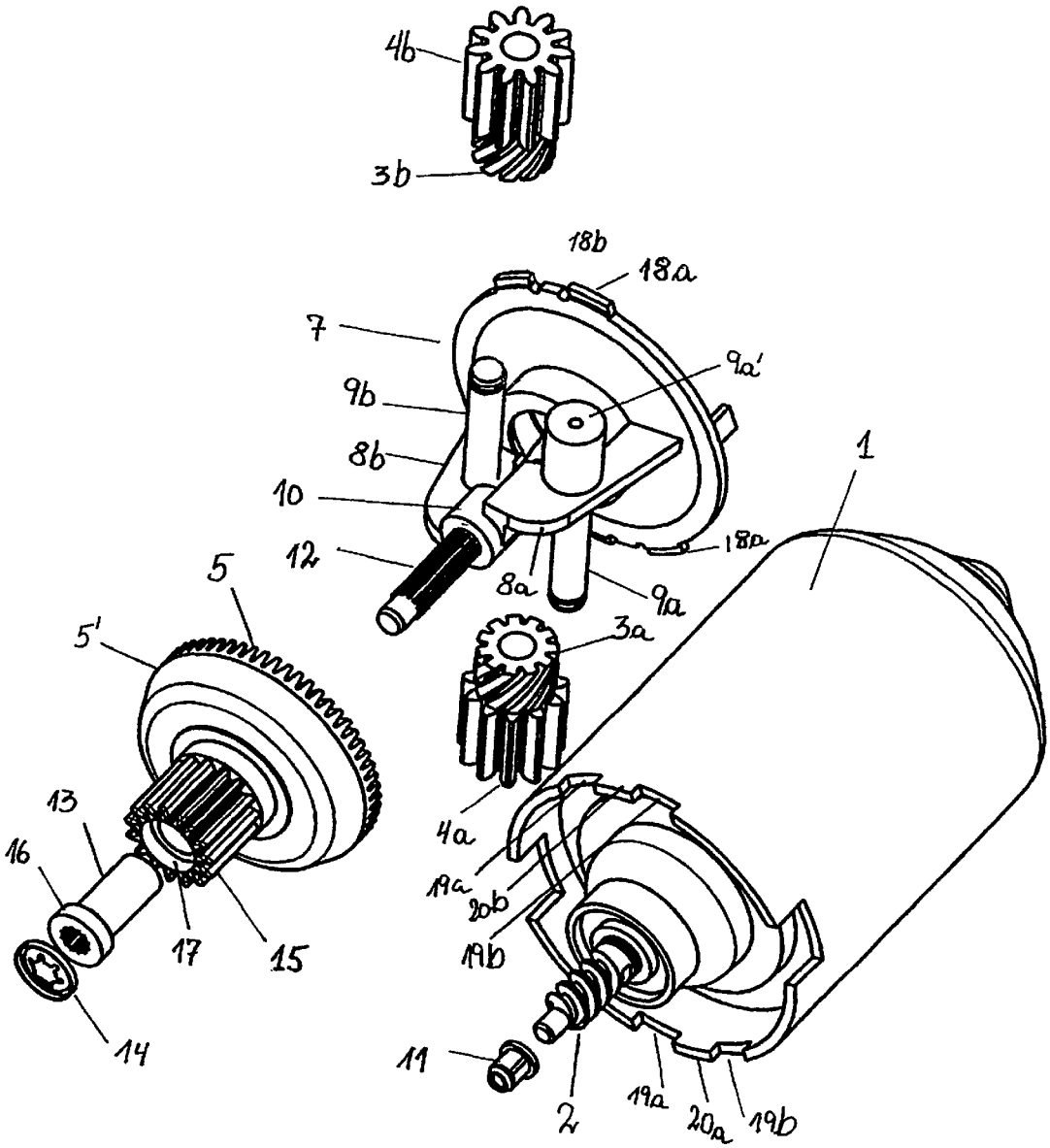
FIG. 4 is an exploded view thereof.
Figure 6:
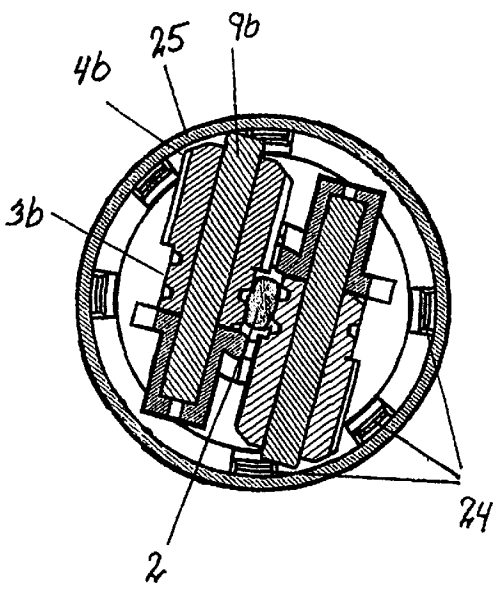
FIG. 6 shows a cross-section along line VI—VI in the embodiment shown in FIG. 5.

As will appear from FIG. 4, the motor housing is here provided with a front cover 7 moulded in lightweight metal.

This cover 7 has two forwardly directed brackets 8*a*, 8*b*, each with a shaft 9*a*, 9*b* for a worm and bevel wheel 3*a*, 4*a*; 3*b*, 4*b* which is secured on the shafts with a locking ring in a groove on the end of the shafts. The shafts 9*a*, 9*b* are steel shafts which are secured with the end in a well 9*a*' on the brackets intended for the purpose.

Forwardly, the brackets 8*a*, 8*b* merge into a cylinder 10 positioned therebetween. The end of the cylinder facing inwards toward the motor has a hole with an inserted bearing bushing 11, in which the end of the worm gear 2 is mounted. In addition to being stabilized in the centre by the two worm wheels 3*a*, 3*b*, the worm gear is thus also prevented from flexing by mounting of its free end.

Figure 5:
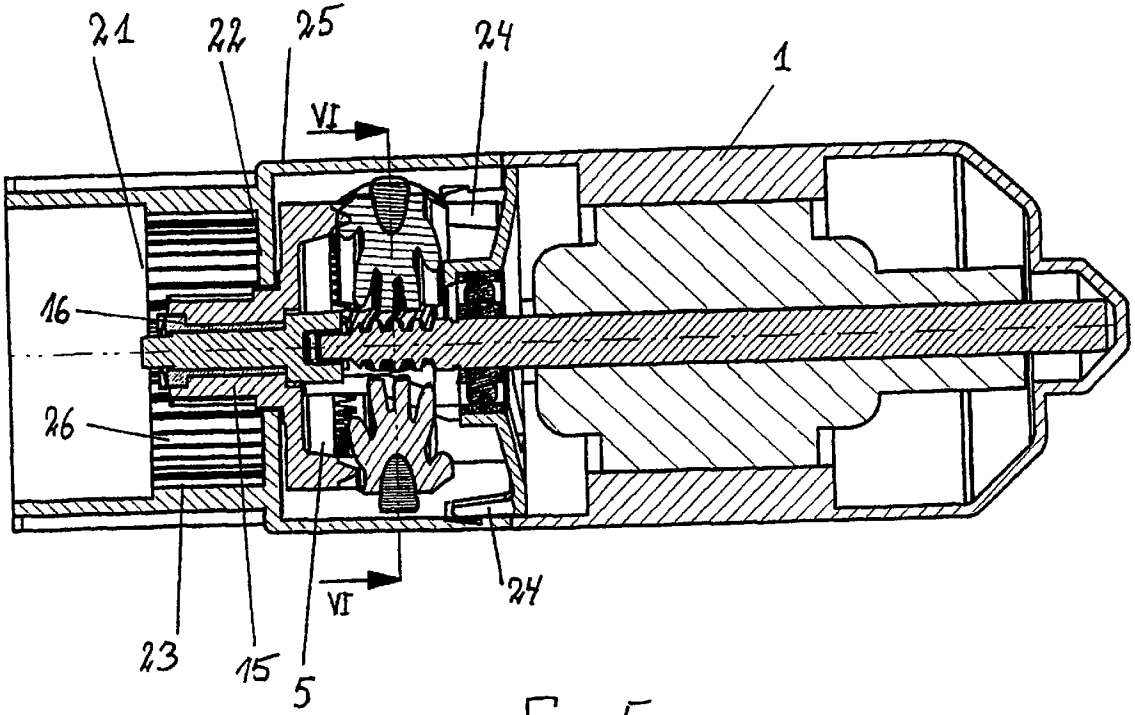
FIG. 5 shows a longitudinal section through an embodiment with a planetary gear.

A forwardly directed shaft 12, which is arranged in extension of the motor shaft, is provided at the opposite end of the cylinder 10. The shaft 12 is shown here as a loose steel shaft secured in a hole in the cylinder, but the shaft may also be moulded integrally with the cylinder, as indicated in FIG. 5. A bearing bushing 13 is arranged on the shaft 12, secured against rotation by longitudinal grooves and splines, just as the bushing is secured on the shaft by a locking washer 14.

Integrally moulded with the crown wheel 5 is a toothed wheel 15 which forms a sun wheel in a subsequent planetary gear. The sun wheel 15 gives an extra long bearing face for the crown wheel as a whole. The crown wheel 5 is mounted here on the bearing bushing 13 and secured against skidding by a collar 16, which is received in a recess 17 at the end of the sun wheel. The crown wheel may be moulded with a two-jawed tool, where the dividing face is at the root 5' of the toothing of the crown wheel, and so may worm/bevel wheel, with the parting face being naturally positioned at the dividing line between these.

FIGS. 5 and 7 show an embodiment with a planetary gear 21 after the crown wheel. The principle is generally as shown in FIGS. 3 and 4, and the same parts have the same reference numerals. The appearance of worm wheel/crown wheel in FIG. 5 is due to the way in which the section is made. The planetary gear is here incorporated in a housing 25, which with one end fits over worm gear, worm/bevel wheel and crown wheel. The housing includes a transverse wall 22 with a bore for the toothed wheel 15 of the crown wheel, which protrudes into the other end of the housing and meshes with a planetary wheel 26, which in turn meshes with an internal toothing 23 in the housing. The toothed wheel 15 of the crown wheel thus forms a sun wheel in the planetary gear. The housing 15 is secured to the motor housing by snap locking legs 24 formed in the front cover 7. The ends of the snap locking legs 24 engage with mating notches on the inner side of the housing. The planetary gear as a whole may thus be snapped firmly on to the front end of the motor.

As will appear, the structure is compact in the transverse as well as in the longitudinal direction. There is a good and balanced distribution of forces. The crown wheel is firmly mounted and additionally supported by two diametrically positioned bevel wheels. The structure is composed of few parts which are easy to assemble. The gearing is relatively high. The order 1:30 may be given by way of example, distributed equally between worm/worm wheel and bevel wheel/crown wheel. In addition, the transmission has a low level of noise. Finally, the advantage of in-line gearing should be mentioned, i.e., with the drive shaft in extension of the motor shaft.

What is claimed is:

1. A compact actuator for operating an activating element, said actuator comprising:

an electric motor which defines a front end and which includes an output shaft extending away from the front end, said output shaft defining a shaft axis, and a transmission for connection to the activating element, said transmission comprising first and second stages, said first stage comprising a worm gear aligned with said output shaft and driven thereby and a first worm wheel driven by said worm gear, and said second stage comprising a crown wheel which faces the front end of the electric motor and a first bevel wheel which is driven by the first worm wheel and which drives the crown wheel, said crown wheel including a power take-off means which extends in substantial coaxial alignment with the axis of said output shaft.

2. A compact actuator according to claim 1, wherein said first worm wheel and said first bevel wheel are positioned on one side of said output shaft and wherein said transmission includes a second worm wheel which is driven by the worm gear and a second bevel wheel which is driven by the second worm wheel and which drives the crown wheel, said second worm wheel and said second bevel wheel being located on a second side of said output shaft diametrically opposite the first worm wheel and first bevel wheel.

3. A compact actuator according to claim 1, wherein the first worm wheel and the first bevel wheel are formed as a one-piece element.

4. A compact actuator according to claim 3, wherein the second worm wheel and the second bevel wheel are formed as a one-piece element.

5. A compact actuator according to claim 1, wherein the power take-off means comprises a toothed wheel having axis-parallel teeth around a periphery thereof.

6. A compact actuator according to claim 5, wherein said transmission includes a planetary gear engaged with said toothed wheel.

7. A compact actuator according to claim 5, wherein said crown wheel and said toothed cylindrical wheel are formed as a one-piece element.

8. A compact actuator according to claim 1, including a removable front cover for said motor, said front cover including first and second brackets that extend forwardly thereof and which mount a cylinder element therebetween, said output shaft extending into a bearing bushing in said cylinder element.

9. A compact actuator according to claim 8, wherein each said first and second brackets mounts respective first and second mounting shafts on which said first and second worm wheels and bevel wheels are respectively rotatably mounted.

10. A compact actuator according to claim 9, including a third mounting shaft that extends forwardly of said cylinder element and on which said crown wheel is rotatably mounted.

11. A compact actuator according to claim 10, including a bearing bushing located between said crown wheel and said third shaft.

12. A compact actuator according to claim 1, wherein each of said first worm wheel, first bevel wheel and crown wheel is made of plastic.

* * * * *